US009258649B2

(12) United States Patent
Tanaka

(10) Patent No.: US 9,258,649 B2
(45) Date of Patent: Feb. 9, 2016

(54) SPEAKER DEVICE

(71) Applicant: Kenta Tanaka, Fujisawa (JP)

(72) Inventor: Kenta Tanaka, Fujisawa (JP)

( * ) Notice: Subject to any disclaimer, the term of this patent is extended or adjusted under 35 U.S.C. 154(b) by 173 days.

(21) Appl. No.: 14/057,543

(22) Filed: Oct. 18, 2013

(65) Prior Publication Data

US 2014/0119556 A1 May 1, 2014

(30) Foreign Application Priority Data

Oct. 29, 2012 (JP) ..... 2012-237748

(51) Int. Cl.

| | |
|---|---|
| ***H04R 9/06*** | (2006.01) |
| *H04R 9/02* | (2006.01) |
| *H04R 1/10* | (2006.01) |

(52) U.S. Cl.

CPC ..... *H04R 9/06* (2013.01); *H04R 1/1075* (2013.01); *H04R 1/1016* (2013.01); *H04R 9/025* (2013.01)

(58) Field of Classification Search

None

See application file for complete search history.

(56) References Cited

U.S. PATENT DOCUMENTS

| | | | | |
|---|---|---|---|---|
| 6,768,806 | B1 * | 7/2004 | Button et al. | 381/401 |
| 2004/0136558 | A1 * | 7/2004 | Usuki et al. | 381/394 |
| 2005/0220320 | A1 * | 10/2005 | Kim et al. | 381/396 |
| 2007/0165902 | A1 * | 7/2007 | Matsumura | H04R 9/025 381/396 |
| 2010/0177927 | A1 * | 7/2010 | Sano | H04R 9/025 381/400 |
| 2011/0255715 | A1 * | 10/2011 | Doh et al. | 381/162 |
| 2013/0195293 | A1 * | 8/2013 | Ko | 381/191 |
| 2014/0270326 | A1 * | 9/2014 | Croft, III | 381/398 |

FOREIGN PATENT DOCUMENTS

| | | | |
|---|---|---|---|
| JP | 61-018297 | A | 1/1986 |
| JP | 2010-283643 | A | 12/2010 |

* cited by examiner

*Primary Examiner* — Thang Tran

(74) *Attorney, Agent, or Firm* — Westerman, Hattori, Daniels & Adrian, LLP

(57) ABSTRACT

A vibrating film 47 is supported by a cylindrical body frame 31, and a first driving unit 61 for driving the vibrating film 47 based on an applied voice signal, is disposed in the body frame 31 on one surface side of the vibrating film 47, and a second driving unit 75 for driving the vibrating film 47 in the same direction as a vibrating direction of the vibrating film 47 driven by the first driving unit 61 based on the applied voice signal, is disposed in the body frame 31 on the other surface side of the vibrating film 47.

11 Claims, 8 Drawing Sheets

A

B

SPEAKER DEVICE

BACKGROUND

1. Technical Field

The present invention relates to a speaker device, and relates to an improvement of the speaker device suitably used for an earphone device such as an earphone or a headphone, etc., for example, which is worn in an ear of a user.

2. Description of Related Art

Conventionally, for example a structure shown in FIG. 6 is known as the earphone device worn in the ear of the user. In this structure, one of the end faces of a cylindrical magnet 5 is fixed to an inside of a cup-shaped yoke 3 disposed in a case body 1; a thin vibrating film 7 is fixed to a tip of the yoke 3 to thereby cover an opening part of the yoke 3; the vibrating film 7 and the other end face of the magnet 5 are disposed to face each other; and a cylindrical coil 9 fixed to the vibrating film 7, is inserted into an outer periphery of the magnet 5, with a slight space provided between them.

In FIG. 6, the case body 1 is composed of a funnel-shaped base part 1*a* and a front cover 1*b* covering a top end (right side in the figure) of the base part 1*a*. The yoke 3 is supported in the case body 1 by fixing the top end of the opening part to the inside of the front cover 1*b*.

Reference number 11 in FIG. 6 indicates a plurality of sound holes formed on a front cover 1*b* in penetrating manners on a front face of the vibrating film 7, and reference number 13 indicates a cable led out to outside. The cable 13 has a knot 13*a* in the base part 1*a*. are formed in penetrating manners at sites corresponding to In this earphone device, a driving unit 15 for vibrating the vibrating film 7 is formed by the magnet 5 and the coil 9, and a voice signal is applied to the coil 9 from outside through the cable 13, so that the vibrating film 7 is vibrated by an operation of the driving unit 15 to thereby emit a sound, and the emitted sound is transmitted to the outside from the sound holes 11 on the front face of the vibrating film 47.

Then, such a kind of earphone device is formed into an external auditory canal inserting type and is put to practical use as a product actually.

The structure of the external auditory canal inserting type earphone device as shown in FIG. 7, is obtained by slightly modifying the structure of FIG. 6 for example, and the earphone device with this structure is used in such a way that the case body 1 is inserted into a cavity of concha 23 surrounded by tragus 17, antitragus 19, and concha 21 of a user so that the vibrating film 7 is approached to the cavity of concha 21, and a sound transmitting cylindrical body 27 protruded from the case body 1, is inserted into an external auditory canal 25 which extends to an eardrum (not shown) from the cavity of concha 23.

A coaxial shape (see FIG. 7) with a central axis of the vibrating film 7 and a central axis of the sound transmitting cylindrical body 27 aligned to each other, and a non-coaxial shape (see FIG. 8) with the central axis of the sound transmitting cylindrical body 27 set obliquely to the central axis of the vibrating film 7, can be given as actual products. FIG. 7 and FIG. 8 show a state that the earphone device is worn on a left ear.

Note that reference number 29 in FIG. 7 and FIG. 8 indicates a flexible ear chip (ear pat, ear piece) fit to an outer periphery of the sound transmitting cylindrical body 27, which is elastically abutted on an inner wall of the external auditory canal 25.

Incidentally, Japanese Patent Laid Open Publication No. 2010-283643 (patent document 1) discloses the earphone device as a publicly-known example.

PATENT DOCUMENT 1

Japanese Patent Laid Open Publication No. 2010-283643

However, above-mentioned any one of the earphone devices has a structure composed of the yoke 3, the magnet 5, the vibrating film 7, and the coil 9 arranged in the case body 1 as a set. Probably this structure has a structural limit in responding to a request of a user such as a higher quality and higher output of a driving sound.

Therefore, as a result of strenuous efforts by inventors of the present invention regarding various structures, it is found that the higher quality and higher output of the driving sound can be achieved by combining structures of a plurality of speakers. Thus, the present invention is completed.

In order to solve the above-mentioned subject, the present invention is provided, and an object of the present invention is to provide a speaker device capable of realizing the higher quality and higher output of the driving sound.

SUMMARY OF THE INVENTION

In order to solve the above-mentioned subject, a speaker device includes:

a cylindrical body frame;

a vibrating film supported in the body frame so as to close the body frame;

a first driving unit disposed in the body frame on one surface side of the vibrating film and configured to drive the vibrating film based on an applied voice signal; and a second driving unit disposed in the body frame on the other surface side of the vibrating film and configured to drive the vibrating film based on the applied voice signal, in the same direction as a vibrating direction of the vibrating film vibrated by the first driving unit.

In the speaker device of the present invention, the first driving unit includes:

a magnetic first yoke disposed in the body frame so as to face a central area of the vibrating film on one surface side of the vibrating film, and formed into a cup-shape;

a first magnet disposed in the first yoke so as to face the central area of the vibrating film; and a cylindrical first coil fixed to the vibrating film on one surface side of the vibrating film, and inserted into an outer periphery of the first magnet, with a slight space provided between them, and the second driving unit includes:

a magnetic second yoke disposed in the body frame so as to face an annular outer peripheral area surrounding the central area of the vibrating film on the other surface side of the vibrating film, and formed into a ring-shape;

a ring-shaped second magnet disposed on a vibrating film side of the second yoke so as to face the outer peripheral area; and a cylindrical second coil fixed to the vibrating film on the other surface side of the vibrating film, and inserted into an inner periphery of the second magnet, with a slight space provided between them.

According to another aspect of the speaker device of the present invention, the first and second coils are configured to drive the vibrating film based on the same voice signal in the same phase.

According to another aspect of the speaker device of the present invention, the first and second coils are fixed to both surfaces of the vibrating film, in the same shape and at the same position.

According to another aspect of the speaker device of the present invention, the first and second magnets are formed so that the sides facing the vibrating film are mutually magnetized in heteropolarity, and the first yoke has an annular outer wall extending to the vicinity of a tip of the vibrating film of the first magnet with the first coil interposed between them, and the second yoke has an annular inner wall extending to the vicinity of the tip of the vibrating film of the second magnet with the second coil interposed between them.

According to another aspect of the speaker device of the present invention, lead wires for applying the voice signal to the first and second coils, are formed so as to be led out from the first and second coils to an outer edge diagonally on one surface side and the other surface side of the vibrating film.

According to the speaker device of the present invention, the vibrating film supported in the body frame is vibrated and driven by the first driving unit disposed on one surface side of the vibrating film, and is driven in the same direction as the first driving unit, by the second driving unit disposed on the other surface side of the vibrating film. Therefore, the higher quality and higher output of the driving sound can be achieved.

According to the speaker device of the present invention, the first driving unit has the first yoke disposed to face the central area of the vibrating film on one surface side of the vibrating film; the first magnet disposed in the first yoke so as to face the central area of the vibrating film; and the first coil fixed to the vibrating film and inserted into the outer periphery of the first magnet, with a slight space provided between them, and the second driving unit has a ring-shaped second yoke disposed to face the outer peripheral area of the vibrating film on the other surface side of the vibrating film; a ring-shaped second magnet disposed to face the outer peripheral area of the vibrating film on the vibrating film side of the second yoke; and the second coil fixed to the vibrating film on the other surface side of the vibrating film and inserted into the inner periphery of the second magnet, with a slight space provided between them. In the magnet structure with this structure, one sheet of vibrating film is driven by two coils of the first and second coils, to thereby reduce a distortion of the coils in an odd-order and realize the higher quality of the driving sound and also facilitate the higher output of the driving sound.

According to the speaker device of the present invention, the first and second coils are configured to drive the vibrating film based on the same voice signal in the same phase. With this structure, it is easy to apply the voice signal to the vibrating film.

According to the speaker device of the present invention, the first and second coils are configured to be same having the same shape, and are fixed to both surfaces of the vibrating film. With this structure, there is little variation in driving the vibrating film by the first and second driving units, and higher sound quality can be secured.

According to the speaker device of the present invention, the first and second magnets are mutually magnetized in the heteropolarity on the side facing the vibrating film, and the first yoke has the annular outer wall extending to the vicinity of the tip of the vibrating film of the first magnet with the first coil interposed between them, and the second yoke has the annular inner wall extending to the vicinity of the tip of the vibrating film of the second magnet with the second coil interposed between them. With this structure, leakage magnetic flux froth the first and second magnets is reduced, and magnetic flux density is improved, to thereby realize higher driving power and easily obtain higher sound quality.

According to the speaker device of the present invention, the lead wires of the first and second coils are formed so as to be led out diagonally on one surface side and the other surface side of the vibrating film, to thereby apply the voice signal to the first and second coils. With this structure, stress added on the vibrating film is dispersed, and the higher quality sound can be easily secured.

DETAILED DESCRIPTION OF THE INVENTION

Embodiments of a speaker device according to the present invention will be described hereafter, with reference to the drawings.

Figure 1:
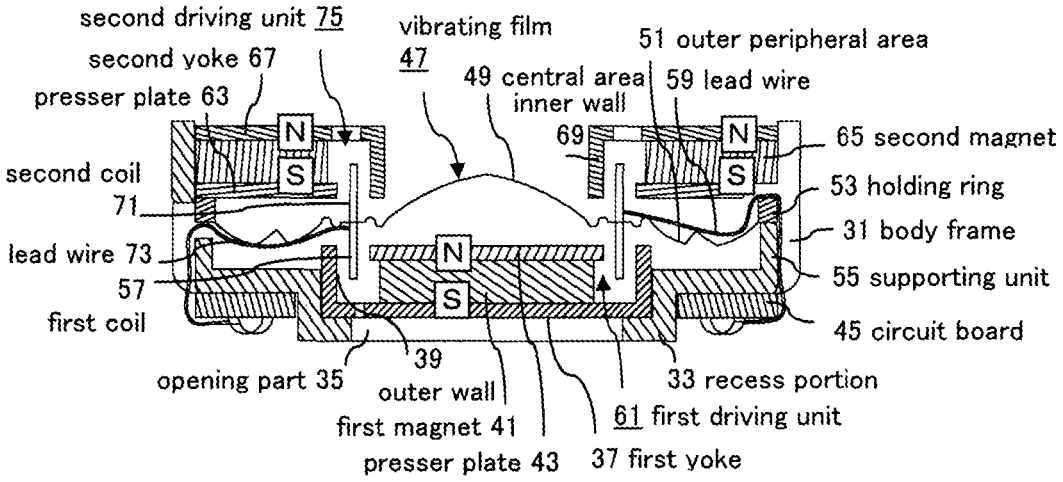
FIG. 1 is a cross-sectional view showing an embodiment of a speaker device according to the present invention.
Figure 2:
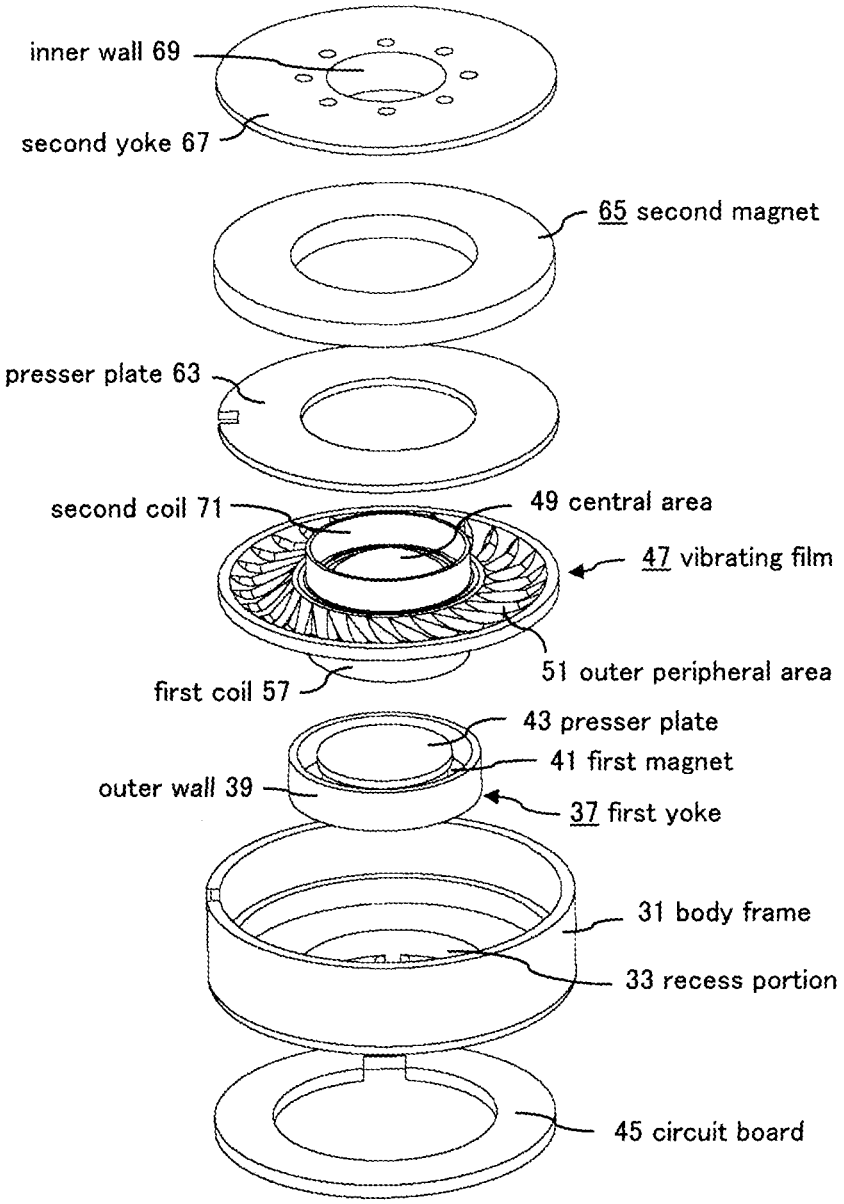
FIG. 2 is a developed perspective view of an essential part showing the speaker device of FIG. 1.

FIG. 1 and FIG. 2 are cross-sectional view and a developed perspective view of an essential part, showing the speaker device according to an embodiment of the present invention, with an earphone device taken as an example.

In FIG. 1 and FIG. 2, a body frame 31 is formed into a cylindrical shape with a bottom, which is made of insulating synthetic resin, and has a recess portion 33 on a bottom part. An opening part 35 is formed in this recess portion 33.

The first yoke 37 is formed into a cup-shape, made of a magnetic material, and is fixed to an inside of the recess portion 33 of the body frame 31, with an opening part disposed at an upper side in the figure. Reference number 39 indicates an annular outer wall extending to the vicinity of a vibrating film 47 described later from an outer peripheral edge of the first yoke 37.

One end face of the cylindrical first magnet 41 is superposed on an inner bottom of the first yoke 37, and the other end face (tip surface) of the first magnet 41 is disposed at a position corresponding to the top end of the outer wall 39 of the first yoke 37.

A disc-shaped presser plate 43 made of a magnetic material is superposed on the tip surface of the first magnet 41.

The first yoke 37, the first magnet 41, and the presser plate 43 are integrally and coaxially fixed by an adhesive agent not shown. The top end of the outer wall 39 of the first yoke 37 is positioned at the same level as the presser plate 43, and faces a presser plate 63 described later.

In the first magnet 41, the side of the recess portion 33 of the first yoke 37 is magnetized in S-pole, and the side of a vibrating film 47 described later is magnetized in N-pole for example. Therefore, the presser plate 43 is also magnetized in N-pole.

A ring-shaped circuit board 45 is superposed on the outer periphery of the recess portion 33 on a bottom outer surface of the body frame 31, so as to be fixed to the body frame 31. The voice signal is supplied to the circuit board 45 from electronic equipment (not shown) through a cable not shown (see FIG. 6).

The vibrating film 47 is formed into a disc-shape from a conventionally publicly-known film material, and has a central area 49 formed by making a central part upwardly swelled into a protrusion shape in the figure, and has an annular outer peripheral area 51 surrounding the central area 49. An outer edge of the outer peripheral area 51 of the vibrating film 47 is fixed to a holding ring 53 described later.

The outer peripheral area 51 of the vibrating film 47 has radial fine ridges/grooves called a so-called corrugation edge, in a slightly recessed shape compared with the central area 49 (see FIG. 2).

The holding ring 53 is mounted on and fixed to a supporting unit 55 which is formed in an axially middle part in the body frame 31. The vibrating film 47 is supported by this supporting unit 55 so as to close the middle part of the body frame 31 through the holding ring 53.

The supporting unit 55 is partially and annularly formed on an inner wall of a trunk portion of the body frame 31 made of a plastic material for example.

One end face side of a cylindrical first coil (voice coil) 57 is fixed to an annular border between the central area 49 and the outer peripheral area 51 so as to surround the central area 49, on one surface side (lower surface side in the figure) of the vibrating film 47. The first coil 57 is inserted into the outer periphery of the first magnet 41, with a slight space provided between them.

Therefore, the outer periphery of the first magnet 41 and the outer wall 39 of the first yoke 37 are annularly faced each other, with the first coil 57 interposed between them.

On the same surface as the first coil 57 in the vibrating film 47, a lead wire 59 is extended from the first coil 57 to an outer edge and is connected to the circuit board 45. The vibrating film 47 is vibrated by applying the voice signal to the first coil 57 through the lead wire 59.

Namely, a first driving unit 61 for vibrating and driving the vibrating film 47 is formed by the first yoke 37, the first magnet 41, and the first coil 57. A so-called inner magnet type speaker is constituted of the above-mentioned constituent elements.

The presser plate 63 which is formed into a ring plate shape and made of a magnetic material, is fixed to the middle part of the trunk portion of the body frame 31 so as to face the outer peripheral area 51 of the vibrating film 47, on the other surface side of the vibrating film 47.

One of the end faces of a cylindrical second magnet 65 is superposed on the surface of the presser plate 63, being the opposite surface to the vibrating film 47. The other end face (tip surface) of the second magnet 65 is positioned in the vicinity of the tip of the trunk portion of the body frame 31.

A ring plate-shaped second yoke 67 made of the magnetic material is superposed on the other end face of the second magnet 65. An inside peripheral edge portion of the second yoke 67 is bent in a direction of the vibrating film 47, and is formed as a columnar inner wall 69 extending to a position of the presser plate 63. An annular space is formed between the inner periphery of the second magnet 65 and the inner wall 69. The second magnet 65 is magnetized in a magnetic force of approximately the same as the magnetic force of the first magnet 41.

In the second magnet 65, for example, the end side of the vibrating film 47 is magnetized in S-pole, and the end side of the second yoke 67 is magnetized in N-pole for example. Therefore, the presser plate 63 is also magnetized in S-pole.

The presser plate 63, the second magnet 65, and the second yoke 67 are integrally and coaxially fixed by an adhesive agent not shown. The top end of the inner wall 69 of the second yoke 67 and the presser plate 63 are positioned approximately at the same level, and the top end of the inner wall 69 of the second yoke 67 is disposed to face the presser plate 43.

The other end surface side of a second coil (voice coil) 71 which is formed into the same cylindrical shape as the first coil 57, is fixed to the annular border between the central area 49 and the outer peripheral area 51 so as to surround the central area 49, on the other surface side of the vibrating film 47.

The second coil 71 is inserted into the inner periphery of the second magnet 65, with a slight space provided between them, and also is inserted into the inner wall 69 of the second yoke 67, with a slight space provided between them.

Therefore, the inner periphery of the second magnet 65 and the inner wall 69 of the second yoke 67 are annularly faced each other so as to interpose the second coil 71 between them. The first and second coils 57, 71 are fixed to both surfaces of the vibrating film 47, in the same shape and at the same position.

On the same surface as the second coil 71 in the vibrating film 47, a lead wire 73 is extended from the second coil 71 to an outer edge diagonally to the lead wire 59 of the first coil 57, and is connected to the circuit board 45. The vibrating film 47 is configured to be vibrated by applying the voice signal to the second coil 71 through the lead wire 59.

In addition, the voice signal applied to the second coil 71 is the same voice signal applied to the first coil 57, which are connected and supplied so that they are applied in the same phase. The vibrating film 47 is also configured to be vibrated by the second coil 71 in the same direction as a vibrating direction of the vibrating film 47 vibrated by the first coil 57.

Namely, a second driving unit 75 for vibrating and driving the vibrating film 47, is formed by the second magnet 65, the second coil 71, and the second yoke 67. A so-called external magnet type speaker is constituted of the above-mentioned constitutional elements.

The above-mentioned first and second magnets 41, 65 are magnetized all at once, by gripping them by a magnetizing device not shown for example, after the whole body is assembled.

Figure 5:
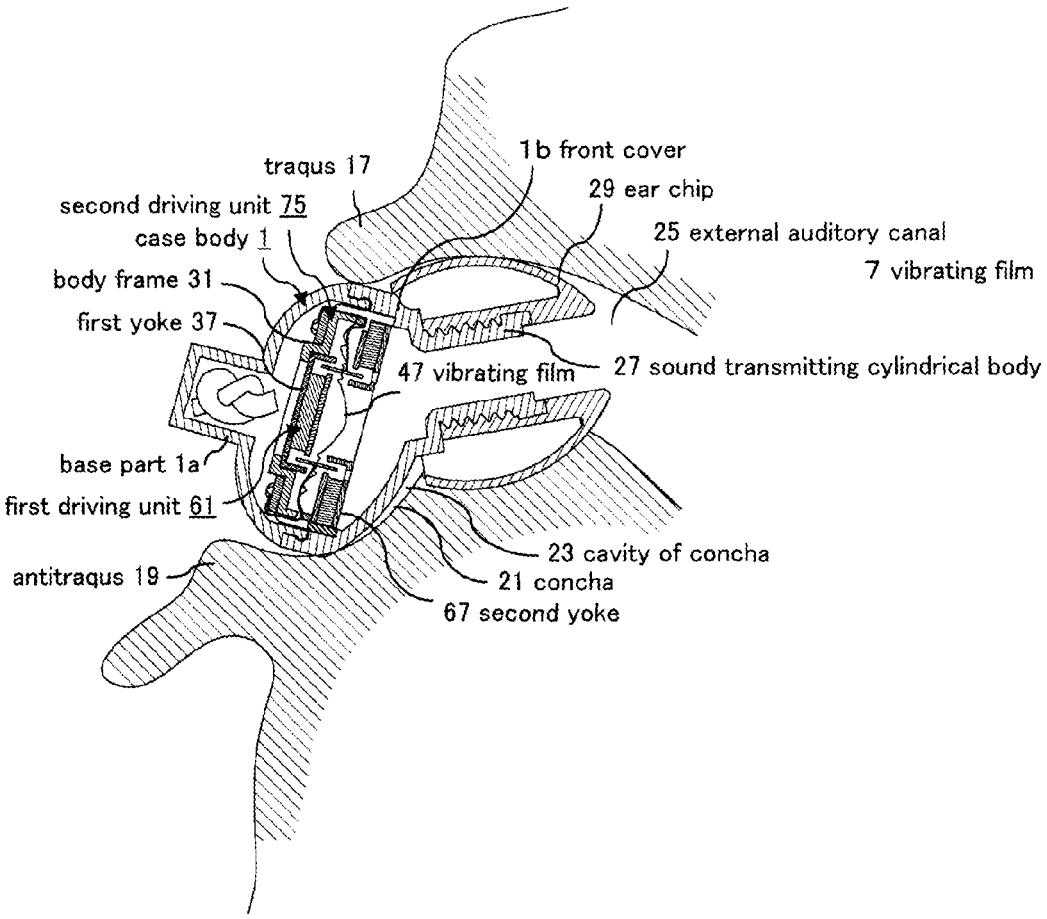
FIG. 5 is an outline view showing a state that the speaker device of FIG. 1 is put to practical use as a product.
Figure 6:
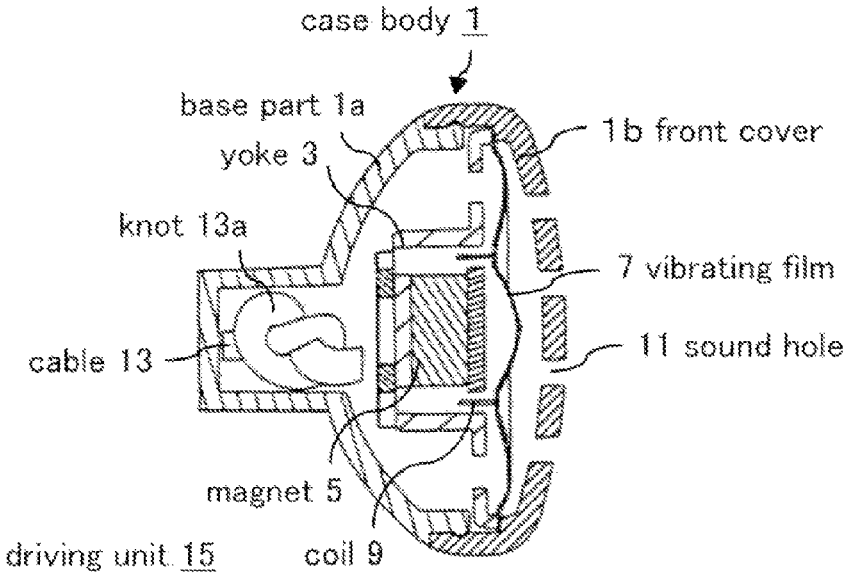
Fig. 6 BACKGROUND ART
FIG. 6 is a cross-sectional view showing a conventional earphone device.
Figure 8:
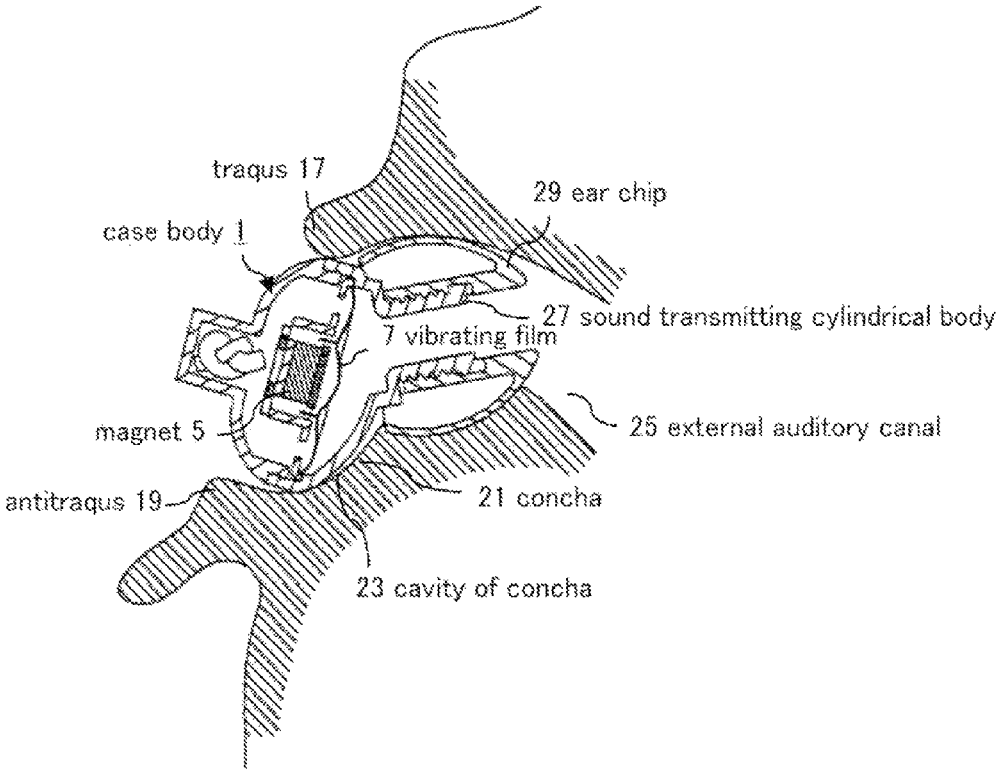
Fig. 8 BACKGROUND ART
FIG. 8 is a cross-sectional view showing the conventional earphone device together with an application example.

The speaker device has a structure for example as shown in FIG. 5 which is based on the above-mentioned FIG. 6 and FIG. 8: namely, the side of the first yoke 37 is disposed at the side of a base part 1*a* of a case body 1, and the second yoke 67 is disposed at the side of a front cover 1*b*, and the body frame 31 is supported by and fixed to the inner wall of the case body 1 (base part 1*a* and the front cover 1*b*). The speaker device with this structure is put to practical use as a product.

Further, in the speaker device having this structure, the vibrating film 47 is vibrated to emit a sound by the first and second driving units 61 and 75, by applying the voice signal to the first and second coils 57 and 71, to thereby transmit a vibration sound to outside.

Figure 7:
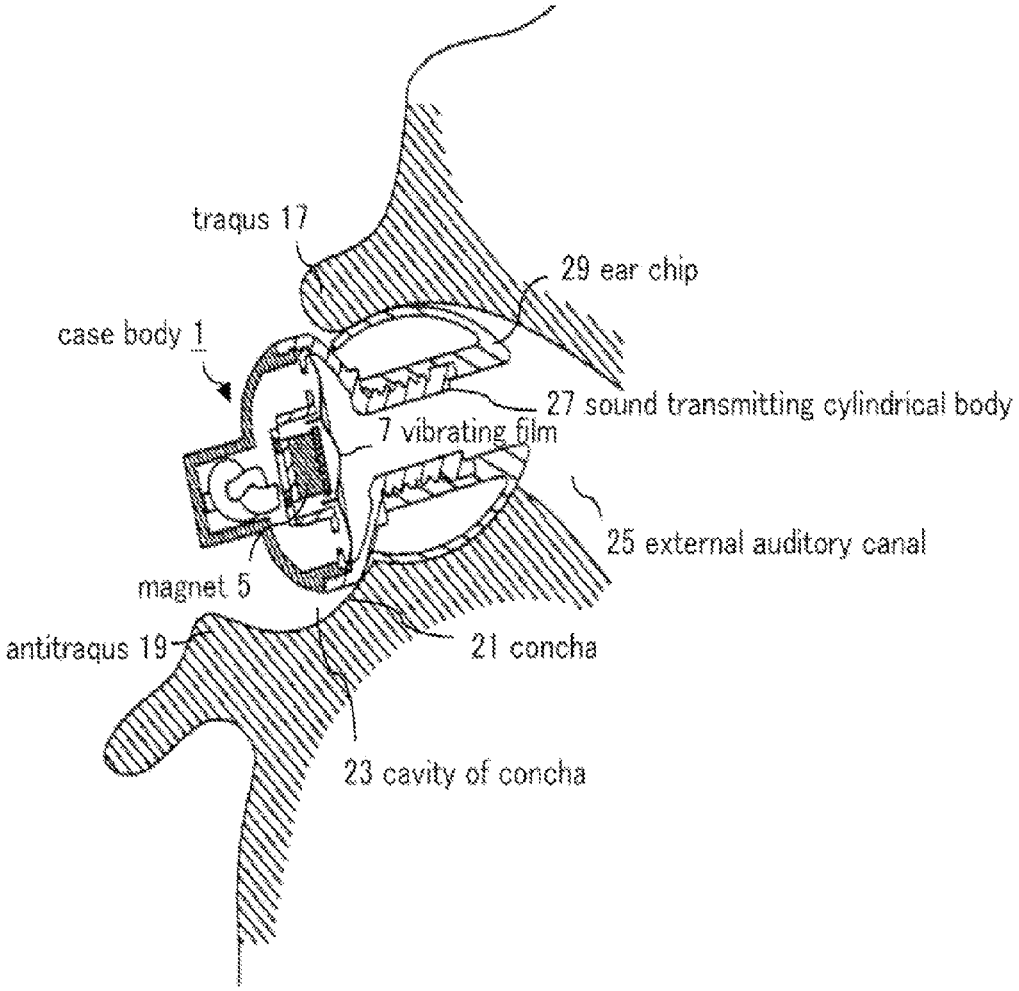
Fig. 7 BACKGROUND ART
FIG. 7 is a cross-sectional view showing the conventional earphone device together with an application example.

Then, the speaker device of the present invention is worn and used in such a way that the cable body 31 is housed in a cavity of concha 23 surrounded by tragus 17, antitragus 19, and concha 21 as shown in FIG. 7 described above, and an ear chip 29 of the tip is inserted into an auditory canal 25.

In addition, the speaker device of the present invention is configured as the inner magnet type speaker and the external magnet type speaker in an upper side and a lower side, with the vibrating film 47 interposed between them, and formed into a push/pull structure as a whole, wherein the first and second coils 57 and 71 are connected so that the same voice signal in the same phase is applied respectively. Therefore, vibration displacement is generated in the vibrating film 47 in the same direction by the first and second coils 57 and 71, to thereby generate a large vibration sound.

In this point, in a speaker simple body having a conventional structure, if a large input signal is inputted to obtain a large vibration sound, an operation of the vibrating film is not in an appearance of a symmetric vibration in an upper (protruding) direction and a lower (recessed) direction, and as shown in FIG. 3A or FIG. 3B, generally distortion is easily generated from one side of the vibration, and therefore it is difficult to cause a symmetric vibration in the vibrating film.

However, in the present invention, as described above, by causing the vibrating film 47 disposed oppositely in an opposed direction, to be vibrated simultaneously in the same direction at the same vibration range, the distortion is mutually complemented, and as shown in a synthetic wave form in this figure C, the vibration of the vibrating film 47 is easily in an appearance of a symmetry with little distortion, and a large waveform is formed.

Further, in the speaker device of the present invention, the facing tip sides of the first and second magnets 41, 65 are magnetized in heteropolarity such as S-pole and N-pole for example, and therefore a repulsive force of magnetic poles between the tips of the first and second magnets 41 and 65 is easily generated.

Then, as shown in FIG. 4A, magnetic flux generated between the tip side of the first or second magnets 41, 65, and the inner wall 69 of the first yoke 37 or second yoke 67 adjacent to the first or second magnet 41, 65, is not widened under an influence of the facing S-pole and the N-pole of the inner wall 69 or the outer wall 39. Generation of a leakage flux between the first magnet 41 and the outer wall 39 of the first yoke 37, and between the second magnet 65 and the inner wall 69 of the second yoke 67, can be easily suppressed, and in addition, flux density is increased. Therefore, driving loss of the vibrating film 47 can be reduced.

In this point, in the speaker simple body having the conventional structure, as shown in FIG. 4B, the magnetic flux is widened to some extent, between the tip side of the first magnet 41 and the outer wall 39 of the first yoke 37 for example, thus generating the leakage flux, and it is difficult to ignore the loss.

Figure 4:
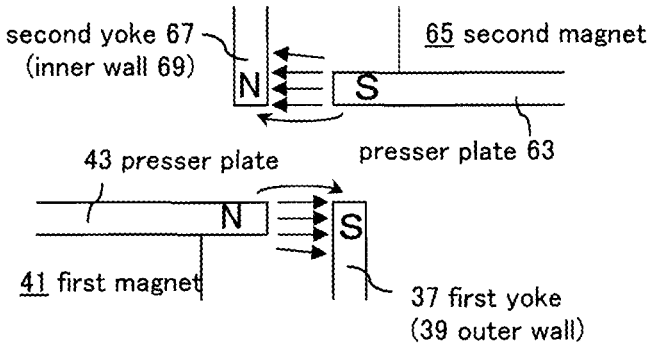
FIG. 4 is an outline view showing the operation of the speaker device of FIG. 1.
Figure 4:
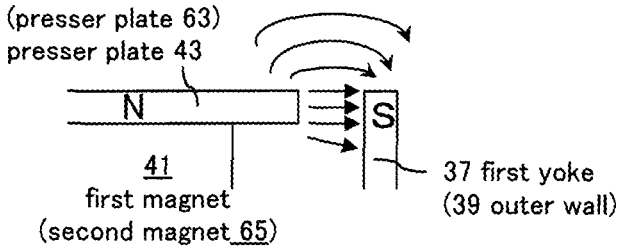

Note that in FIG. 4, the first and second coils 57, 71, and the vibrating film 47 are not shown.

Thus, the speaker device of the present invention includes a cylindrical body frame 31; the vibrating film 47 supported in the body frame 31; the first driving unit 61 disposed in the body frame 31 on one surface side of the vibrating film 47 and is configured to drive the vibrating film 47 based on the applied voice signal; and the second driving unit 75 disposed in the body frame 31 on the other surface side of the vibrating film 47 and is configured to drive the vibrating film 47 in the same direction as the vibrating direction in which the vibrating film 47 is vibrated by the first driving unit 61 based on the applied voice signal.

In addition, the first driving unit 61 has the magnetic first yoke 37 disposed in the body frame 31 so as to face the central area of the vibrating film 47 on one surface side of the vibrating film 47 and formed into a cup-shape; the first magnet 41 disposed in the first yoke 37 so as to face the central area 49 of the vibrating film 47; and the cylindrical first coil 57 fixed to the vibrating film 47 on the other surface side of the vibrating film 47 and inserted into the outer periphery of the first magnet 41, with a slight space provided between them, and the second driving unit 75 has the magnetic second yoke 67 disposed in the body frame 31 so as to face the annular outer peripheral area 51 surrounding the central area 49 of the vibrating film 47 on the other surface side of the vibrating film 47; the ring-shaped second magnet 65 disposed on the vibrating film side of the second yoke 67 so as to face the outer peripheral area 51; and the cylindrical second coil 71 fixed to the vibrating film 47 on the other surface side of the vibrating film 47 and inserted into the inner periphery of the second magnet 65 with a slight space provided between them.

Therefore, the vibrating film 47 is driven in the same direction from its both surface sides by the first and second driving units 61, 75, and therefore the vibrating film 47 is largely displaced and vibrated, so that the higher output and higher quality of the driving sound can be achieved.

Namely, it is easy to drive one sheet of the vibrating film 47 from both surface sides by two coils of the first and second coils 57, 71, and reduce an odd-order distortion which affects the sound quality adversely in the vibrating film 47, and obtain approximately a symmetric vibration in the upper direction and in the lower direction. Therefore, high response and a clear driving sound can be obtained, and the higher quality of the driving sound can be realized while keeping the driving sound loud.

Thus, the vibrating film 47 is driven based on the same voice signal in the same phase, by the first and second coils 57, 71 of the first and second driving units 61, 75. Therefore, the present invention can be achieved only by connecting and supplying the voice signal, with a simple connection and supply structure of the voice signal to the first and second coils 57 and 71.

Further, in the speaker device of the present invention, the first and second coils 57, 71 are formed in the same shape and at the same position on both surfaces of the vibrating film 47. Therefore, variation of the constituent components can be suppressed to be small, then uniform constituent components can be obtained, and the higher sound quality can be easily secured.

Further, in the speaker device of the present invention, the first and second magnets 41 and 65 are formed so that the sides facing the vibrating film 47 are mutually magnetized in heteropolarity, and the first yoke 37 has an annular outer wall 39 extending to the vicinity of the tip of the vibrating film 47 of the first magnet 41 with the first coil 57 interposed between them, and the second yoke 67 has an annular inner wall 69 extending to the vicinity of the tip of the vibrating film 47 of the second magnet 65 with the second coil 71 interposed between them. Therefore, the leakage flux can be reduced, the flux density can be improved, the driving force can be increased, and the high sound quality can be easily secured. In addition, a magnetizing structure and a magnetizing work are simple.

Further, in the speaker device of the present invention, the lead wires 59, 73 for applying the voice signal to the first and second coils 41 and 71, are formed so as to be led out from the first and second coils 41 and 71 to the outer edge diagonally on one surface side and the other surface side of the vibrating film 47. Therefore, the stress added on the vibrating film 47 is dispersed, and the higher sound quality can be secured.

Incidentally, as described above, the structure of the speaker device of the present invention is not limited to a combination structure of the inner magnetic type speaker and the external magnetic type speaker using magnets. The speaker device of the present invention has the structure including the cylindrical body frame 31; the vibrating film 47 supported in the body frame 31 so as to close the body frame 31; the first driving unit 61 disposed in the body frame 31 on one surface side of the vibrating film 47 and configured to drive the vibrating film 47 based on the applied voice signal; and the second driving unit 75 disposed in the body frame 31 on the other surface side of the vibrating film 47 and configured to drive the vibrating film 47 based on the applied voice signal in the same direction as the vibrating direction of the vibrating film 47 vibrated by the first driving unit 61. With this structure, the higher quality and higher output of the driving sound can be achieved.

Further, in the speaker device of the present invention, a supporting structure of the vibrating film 47 is not limited to the above-mentioned structure, and the structures of the first and second driving units 61, 75 are not limited to the above-mentioned structure, and the following structure may also be acceptable: namely, the vibrating film 47 is vibrated and driven by the first and second driving units 61 and 75 in the same direction from both surface sides, based on the applied same voice signal.

Further, the speaker device of the present invention can be applied not only to the above-mentioned earphone device, but also to the structure of a large-sized or small-sized headphone or a HiFi speaker, etc.

Figure 3:
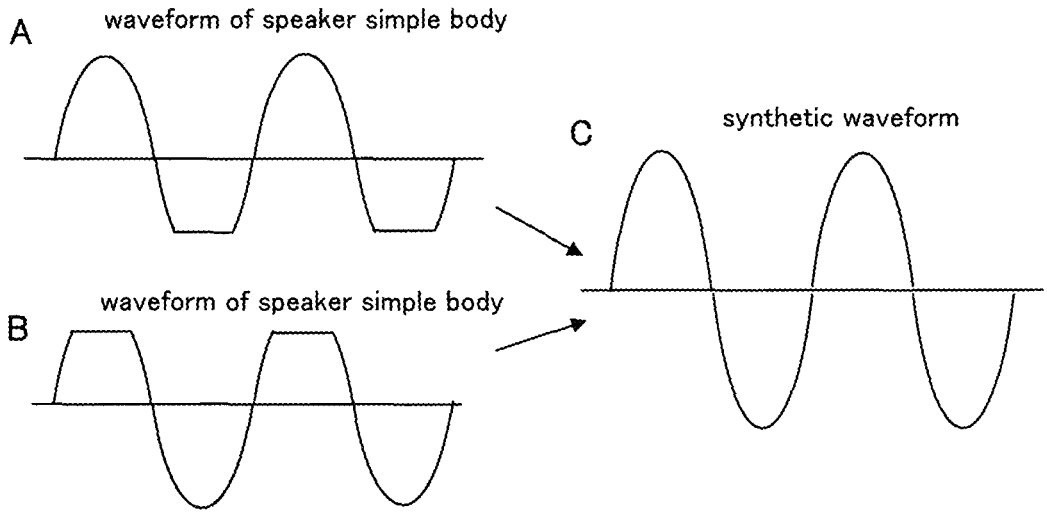
FIG. 3 is a waveform chart showing an operation of the speaker device of FIG. 1.

FIG. 1
31 BODY FRAME
33 RECESS PORTION
35 OPENING PART
37 FIRST YOKE
41 FIRST MAGNET
43 PRESSER PLATE
45 CIRCUIT BOARD
49 CENTRAL AREA
51 OUTER PERIPHERAL AREA
53 HOLDING RING
55 SUPPORTING UNIT
59 LEAD WIRE
61 FIRST DRIVING UNIT
63 PRESSER PLATE
65 SECOND MAGNET
67 SECOND YOKE
69 INNER WALL
71 SECOND COIL
73 LEAD WIRE
75 SECOND DRIVING UNIT
FIG. 2
31 BODY FRAME
33 RECESS PORTION
37 FIRST YOKE
39 OUTER WALL
41 FIRST MAGNET
43 PRESSER PLATE
45 CIRCUIT BOARD
47 VIBRATING FILM
49 CENTRAL AREA
51 OUTER PERIPHERAL AREA
57 FIRST COIL
63 PRESSER PLATE
65 SECOND MAGNET
67 SECOND YOKE
69 INNER WALL
71 SECOND COIL
FIG. 3
A WAVEFORM OF SPEAKER SIMPLE BODY
B WAVEFORM OF SPEAKER SIMPLE BODY
C SYNTHETIC WAVEFORM
FIG. 4A
37 FIRST YOKE (39 OUTER WALL)
43 PRESSER PLATE
63 PRESSER PLATE
65 SECOND MAGNET
67 SECOND YOKE (INNER WALL 69)
FIG. 4B
37 FIRST YOKE (39 OUTER WALL)
41 (SECOND MAGNET 65)
FIG. 5
1 CASE BODY
1*a* BASE PART
1*b* FRONT COVER
17 TRAQUS
19 ANTITRAQUS
21 CONCHA
23 CAVITY OF CONCHA
25 EXTERNAL AUDITORY CANAL
27 SOUND TRANSMITTING CYLINDRICAL BODY
29 EAR CHIP
31 BODY FRAME
37 FIRST YOKE
47 VIBRATING FILM
69 SECOND YOKE
75 SECOND DRIVING UNIT
FIG. 6
1 CASE BODY
1*a* BASE PART
3 YOKE
5 MAGNET
7 VIBRATING FILM
9 COIL
11 SOUND HOLE
13*a* KNOT
15 DRIVING UNIT
FIG. 7
1 CASE BODY
5 MAGNET
17 TRAQUS
19 ANTITRAQUS
21 CONCHA
23 CAVITY OF CONCHA
FIG. 8
1 CASE BODY
5 MAGNET
7 VIBRATING FILM
17 TRAQUS
19 ANTITRAQUS
21 CONCHA
23 CAVITY OF CONCHA
25 EXTERNAL AUDITORY CANAL

What is claimed is:

1. A speaker device comprising:

a cylindrical body flame;

a vibrating film supported in the body flame so as to close the body frame;

a first driving unit disposed in the body flame on one surface side of the vibrating film and configured to drive the vibrating film based on an applied voice signal; and a second driving unit disposed in the body frame on the other surface side of the vibrating film and configured to drive the vibrating film based on the applied voice signal, in the same direction as a vibrating direction of the vibrating film vibrated by the first driving unit;

wherein the second driving unit comprises:

a magnetic second yoke disposed in the body frame so as to face an annular outer peripheral area surrounding the central area of the vibrating film on the other surface side of the vibrating film, and formed into a ring-shape;

a ring-shaped second magnet disposed on a vibrating film side of the second yoke so as to face the outer peripheral area; and a cylindrical second coil fixed to the vibrating film on the other surface side of the vibrating film, and inserted into an inner periphery of the second magnet, with a slight space provided between them.

2. The speaker device according to claim 1, wherein the first driving unit comprises: a magnetic first yoke disposed in the body flame so as to face a central area of the vibrating film on one surface side of the vibrating film, and formed into a cup-shape; a first magnet disposed in the first yoke so as to face the central area of the vibrating film; and a cylindrical first coil fixed to the vibrating film on one surface side of the vibrating film, and inserted into an outer periphery of the first magnet, with a slight space provided between them.

3. The speaker device according to claim 2, wherein the first and second coils are configured to drive the vibrating film based on the same voice signal in the same phase.

4. The speaker device according to claim 3, wherein the first and second coils are fixed to both surfaces of the vibrating film, in the same shape and at the same position.

5. The speaker device according to claim 3, wherein the first and second magnets are formed so that the sides facing the vibrating film are mutually magnetized in heteropolarity, and the first yoke has an annular outer wall extending to the vicinity of a tip of the vibrating film of the first magnet with the first coil interposed between them, and the second yoke has an annular inner wall extending to the vicinity of a tip of the vibrating film of the second magnet with the second coil interposed between them.

6. The speaker device according to claim 3, wherein lead wires for applying the voice signal to the first and second coils, are formed so as to be led out from the first and second coils to an outer edge diagonally on one surface side and the other surface side of the vibrating film.

7. A speaker device comprising:

a cylindrical body frame;

a vibrating film supported in the body frame so as to close the body frame;

a first driving unit disposed in the body frame on one surface side of the vibrating film and configured to drive the vibrating film based on an applied voice signal;

a second driving unit disposed in the body frame on the other surface side of the vibrating film and configured to drive the vibrating film based on the applied voice signal, in the same direction as a vibrating direction of the vibrating film vibrated by the first driving unit;

wherein the first driving unit comprises:

a magnetic first yoke disposed in the body frame so as to face a central area of the vibrating film on one surface side of the vibrating film, and formed into a cup-shape;

a first magnet disposed in the first yoke so as to face the central area of the vibrating film; and a cylindrical first coil fixed to the vibrating film on one surface side of the vibrating film, and inserted into an outer periphery of the first magnet, with a slight space provided between them, and the second driving unit comprises:

a magnetic second yoke disposed in the body frame so as to face an annular outer peripheral area surrounding the central area of the vibrating film on the other surface side of the vibrating film, and formed into a ring-shape;

a ring-shaped second magnet disposed on a vibrating film side of the second yoke so as to face the outer peripheral area; and a cylindrical second coil fixed to the vibrating film on the other surface side of the vibrating film, and inserted into an inner periphery of the second magnet, with a slight space provided between them.

8. The speaker device according to claim 7, wherein the first and second coils are configured to drive the vibrating film based on the same voice signal in the same phase.

9. The speaker device according to claim 8, wherein the first and second coils are fixed to both surfaces of the vibrating film, in the same shape and at the same position.

10. The speaker device according to claim 8, wherein the first and second magnets are formed so that the sides facing the vibrating film are mutually magnetized in heteropolarity, and the first yoke has an annular outer wall extending to the vicinity of a tip of the vibrating film of the first magnet with the first coil interposed between them, and the second yoke has an annular inner wall extending to the vicinity of a tip of the vibrating film of the second magnet with the second coil interposed between them.

11. The speaker device according to claim 8, wherein lead wires for applying the voice signal to the first and second coils, are formed so as to be led out from the first and second coils to an outer edge diagonally on one surface side and the other surface side of the vibrating film.

* * * * *